US007064291B1

(12) United States Patent
Lohmüller et al.

(10) Patent No.: US 7,064,291 B1
(45) Date of Patent: Jun. 20, 2006

(54) ANNEALING PLANT

(75) Inventors: Bernd Lohmüller, Schwabach (DE); Rainer Vockentanz, Schwabach (DE)

(73) Assignee: Maschinenfabrik Niehoff GmbH, Schwabach (DE)

( * ) Notice: Subject to any disclaimer, the term of this patent is extended or adjusted under 35 U.S.C. 154(b) by 0 days.

(21) Appl. No.: 10/069,302

(22) PCT Filed: Aug. 17, 2000

(86) PCT No.: PCT/EP00/08050

§ 371 (c)(1),
(2), (4) Date: May 10, 2002

(87) PCT Pub. No.: WO01/14603

PCT Pub. Date: Mar. 1, 2001

(30) Foreign Application Priority Data

Aug. 19, 1999 (DE) ..... 199 39 399

(51) Int. Cl.
*H05B 3/00* (2006.01)

(52) U.S. Cl. ..... 219/155; 219/50

(58) Field of Classification Search ..... 219/50, 219/155

See application file for complete search history.

(56) References Cited

U.S. PATENT DOCUMENTS 2,806,130 A 9/1957 Gray
3,825,873 A * 7/1974 Herren et al. ..... 439/27
3,989,923 A * 11/1976 Lees et al. ..... 219/155
4,118,617 A * 10/1978 Moreau ..... 219/636
4,221,947 A * 9/1980 Bonikowski et al. ..... 219/636
4,341,168 A 7/1982 Siebert
4,437,904 A * 3/1984 MacCraven ..... 148/511

FOREIGN PATENT DOCUMENTS

DE 1615420 A 8/1970
EP 0 806263 A 11/1997
GB 1211849 A 11/1970

OTHER PUBLICATIONS

Matsumoto J et al "Spot Welding of Aluminium Alloy-Electrode Life for Various Electrodes", Welding International, GB, Welding Institute, Abington, Cambridge GB.

* cited by examiner

*Primary Examiner*—Len Tran
(74) *Attorney, Agent, or Firm*—Marshall, Gerstein & Borun LLP

(57) ABSTRACT

An annealing apparatus for annealing metallic billets, particularly for use in annealing aluminum-containing billets, comprising at least two contact elements or contact discs made of electrically conducting material, the contact elements being connected to a voltage source so as to provide electric current flow through the billet as it passes between the two contact elements. The material of the contact elements is a light metal, normally aluminum or an aluminum-containing alloy, such that the contact element material is matched to the material of the billet and diffusion of the billet material into the contact element is substantially avoided.

28 Claims, 1 Drawing Sheet

ANNEALING PLANT

FIELD OF THE INVENTION

The present invention relates to an annealing apparatus for the annealing of metallic billets and especially for the annealing of billets containing aluminum, as well as a procedure of manufacturing metallic, low-stressed billets, particularly metallic low-stressed billets which contain aluminum.

BACKGROUND OF THE INVENTION

A billet in the sense of the present invention is in particular a metallic wire which has an integrally-formed cross-sectional area perpendicular to its longitudinal axis or a bundle of such metallic wires.

Subsequent to the cold processing of a metallic billet, and especially after a metallic billet has been drawn, structural changes can be observed in said metallic billet, which is also especially the case with billets made of aluminum or aluminum alloys. These structural changes in particular have an effect of hardening the billet and reducing its elongation at rupture. Such structural changes limit the uses for a billet so that a feasible measure to remedy same consists in stress-relief annealing of the billet, which induces a re-crystallization of its structure. In so doing, the billet is heated employing direct resistance heating for engineering and economic reasons. This direct resistance heating integrates a section of the billet, respectively one billet segment at a time, into an electrical circuit so that an electric current flows through said billet section or segment and, due to the electrical resistance of the billet, at least a portion of the electrical energy is converted to thermal energy, hence heating the billet.

During resistance heating, respectively annealing, the billet is guided, for example continuously, along a plurality of contact plates. Said contact plates are connected to a voltage source such that a current can flow through the metallic billet.

Considerable problems arise when current is transmitted from contact plates to billets containing aluminum or aluminum alloys. Such problems give rise to having to operate these types of devices in a cost-intensive manner and result in the quality of the annealed billet not remaining constant over time.

The inventor is additionally aware that billets made of aluminum or of an aluminum alloy are heated in furnaces (furnace or drop annealing) in batch processing. Thus, the billets supported on a metallic spool or other metallic carrier are subjected to a protective gas atmosphere in an annealing furnace for a period of several hours.

Such a process necessitates great technical production expenditures as well as being energy and cost-intensive and furthermore gives rise to extremely long passage times with high process costs and frequently inadequate product quality.

The inventor is moreover aware that in the production of rods, wire is annealed employing a consumptionsly annealing passage process based on a conductive principle, although the quality of such products is generally insufficient in this case as well.

SUMMARY OF THE INVENTION

It is thus the task of the present invention to provide an annealing apparatus for the treatment of a metallic billet, and particularly for the annealing of a billet which contains aluminum, as well as a method of manufacturing a metallic, low-stressed billet, and most notably a low-stressed billet which contains aluminum, in which electrical current can be transmitted to the billet in an economical and structurally simple manner of engineering over short passage times, so that as a result of said current flow, at least a section thereof will be heated, whereby the contact elements transferring the electrical current to the billet will enjoy a long operating life.

A special aspect of the task of the invention is to provide an apparatus which allows for the simplified and improved technical engineering of cold processing and subsequent annealing of a metallic billet, and in particular a billet made of or containing aluminum.

Preferred embodiments of the invention comprise the subject matter of the subclaims.

The present invention proposes an annealing apparatus for annealing a metallic billet which has at least two contact elements made of electrically conducting material which are electrically connected to a voltage source and induce an electrical current to flow through at least one respective segment of the billet when said billet is guided past to come into contact with said contact elements. The contact elements are made of a metal or a metal alloy which matches that of the billet's material to such an extent that basically no material from the billet diffuses into said contact elements. The contact elements are configured as contact plates.

The billet is preferably of a light metal or a light metal alloy. A billet made from aluminum or aluminum alloy is especially preferred. The contact element material is preferably that of the same light metal as is contained in the billet material. It is especially preferred when the contact element material is an alloy of the light metal.

The voltage source may be a three-phase or a direct current source.

The annealing apparatus according to the present invention enables the producing of annealed billet material made of aluminum or aluminum alloy or the like in a technically simple as well as energy and cost-efficient manner, and most notably particularly with a high product quality and low waste factor. Furthermore, the present invention allows for reduced passage times at lower process costs during the manufacture of an annealed billet made of aluminum or aluminum alloy or the like.

Thus, the present invention can, for example, reduce the number of process steps by eliminating the need for a furnace when annealing. Related procedural expenditures are likewise eliminated such as an additional spool transport or needing to respool from the wire spools used in the furnace to synthetic spools used for transport. Since the present invention eliminates the need for lengthy warm-up and continuous heating phases of a wire drum in a furnace, it enables an increase in productivity and a shortening of the passage times. Additionally, an annealing apparatus in accordance with the present invention can be employed very flexibly, having a positive and process-simplifying effect when, for example, annealing different sized drums or differing wire materials.

The quality of an annealed billet produced with the inventive annealing apparatus is improved compared to annealed billets produced especially in furnaces. Waste is likewise reduced. This can be attributed to the present invention precluding such contingencies such as, for example, the wire material sticking to a spool or a wire drum during or after furnace annealing treatment and/or frequently continuing an undesired re-crystallization during the cooling-down phase.

The invention also has advantages from an energy-saving point of view since it avoids any additional expenditure of wasted energy as arises in furnace annealing with respect to, for example, the unnecessary heating of spools or wire drum carriers.

Moreover, the contact elements of the present invention do not exhibit any significant wear. Additionally, the wire surface suffers no damage at the contact points in accordance with the present invention.

Especially preferred is the detachable arrangement of the contact elements, contact plates respectively, on the annealing apparatus so that they may be replaced by others if another type of billet material is to be heated, respectively annealed in said annealing apparatus.

The electrical current is preferably transmitted from the voltage source to the contact elements by means of brushes or the like. The billet material is preferably moved through said annealing apparatus along a predefined transport track through said annealing apparatus, whereby especially a guiding means such as deviating or comb rollers or the like are hereto provided. Especially preferred are guiding means which do not function as contact elements under certain set circumstances so that the billet being transported along the transport track is not subjected to an electrical current flow at predetermined sections within the annealing apparatus.

It is preferred to have a plurality of annealing paths arranged along the transport track whereby one annealing path is disposed at an area of the transport track where the billet, or a portion of the billet, or the segment of the billet presently at this point receives a flow of electrical current as transmitted to the billet by means of the contact elements.

According to a preferred embodiment of the present invention, various different annealing paths of differing lengths and/or which allow for the feeding of varying electrical current energy to the billet are disposed along the transport track.

The invention is in this respect advantageous as it enables significantly prolonging the operating life of the contact plates, contact elements respectively. Hence the invention particularly enables annealing of an aluminum billet by means of conductive heating, respectively direct resistance heating in an economical manner whereby the contact elements are not quickly destroyed, for example just after 15 or 30 minutes.

The invention consequently avoids the situation of aluminum from the billet diffusing into the contact elements which induces intermetallic phases to form in the contact elements and cause material embrittlement. Such material embrittlement causes track grooves to form on the contact elements which in turn can lead to the billet material slipping on the contact elements such that frictional wear results and leads to further destruction of the contact elements or to damaging of the billet.

According to a preferred embodiment of the present invention, the contact elements which are positioned at the same annealing path, meaning in particular the contact element which functions as a positive pole and the contact element which functions as its associated negative pole, are made of the same material.

The present annealing apparatus is preferably disposed with a cold-processing means for processing the billet in cold state whereby it is preferable to draw the billet into the cold-processing means. Particularly preferred is the physical positioning of the cold-processing means in front of an annealing path in the material flow direction. It is preferred to have a plurality of cold-processing means whereby one or more annealing paths are positioned after at least one of the cold-processing means in the material flow direction.

A preferred annealing apparatus in accordance with the present invention is provided with a cooling section as a part of the transport track in which the billet may be cooled. A cooling means or medium is provided for cooling the billet. A billet may be cooled by using oil within the cooling section, with a thin oil being hereby especially preferred.

The billet is preferably moved through the thin oil following the annealing process.

The use of oil as a coolant is in this respect advantageous since oil prevents the formation of oxidation build-up on the surface of a billet or the surface of a billet containing aluminum.

Contingent upon the subsequent use of the billet, when using oil as a coolant, it is preferred to use oil which will essentially have no damaging effects on health.

The use of such an oil is in this respect advantageous because the billet will then be safe to use for clips or staples or other such similar articles which may come into contact with food.

The present annealing apparatus is preferably disposed with a stripping or similar means for removing any coolant or other residue from the surface of the billet. The stripping means is preferably physically positioned after the cooling section in the material flow direction. The stripping means is preferably configured as a die.

The stripping means, which is particularly preferably configured as a die, is preferably cooled and/or lubricated with the same cooling oil as used in the cooling means.

According to an especially preferred embodiment of the present invention, the billet is moved through a protective gas atmosphere at predetermined sections of the transport track with pure nitrogen in particular being hereto employed as a protective gas.

It is preferred that the billet is moved in the transport direction from a cold-processing means through at least one annealing path and subsequently through a cooling section, whereby said cold-processing means is disposed with one or more dies of which a terminal die constitutes the last die in the transport direction. In thus doing, a protective gas atmosphere is provided between the terminal die and the preferably oil-employing cooling section.

The protective gas atmosphere prevents the formation of oxidation build-up on billets and most particularly on billets which contain aluminum.

It is preferred for the annealing apparatus to be disposed with a drawing means, particularly configured as a draw plate, and which can subject the billet to a force which induces the billet to be moved along the transport track at a consistently uniform tension. Such drawing means, draw plate respectively, is preferably disposed with a separate motor, or a motor which is allocated solely to the drawing means, for driving the drawing means, draw plate respectively.

This allows for catching any possible increases in billet speed due to thermal expansion or diameter shrinkage.

It is especially preferred to have a regulating device control the rotational speeds of the different contact plates such that billet slippage is prevented, and notably also including when the billet expands subject to annealing path temperature. Certain predefined parameters can in particular be employed for the regulating control such as annealing temperature, or a parameter representative of the billet material, the length of the annealing path, the diameter of the billet, etc.

In a procedure in accordance with the present invention, the contact elements employed in the annealing apparatus preferably contain aluminum when a billet containing aluminum is to be annealed in said annealing apparatus. Such contact elements are connected to a voltage source such that a billet containing aluminum which comes into physical contact with the contact elements as it is passed by, receives an electrical current flow through its respective sections between the contact elements which induces a heating of the billet such that it is annealed at low stress.

Following annealing, the billet, and most particularly a billet containing aluminum, is preferably cooled by means of an oil, and in particular a thin oil.

The oil fed to cool the billet is preferably stripped off following the cooling process, and most particularly by the employing of a die.

The present invention encompasses a number of additional exemplary embodiments, the description of individual embodiments is not to be considered as waived.

BRIEF DESCRIPTION OF THE DRAWINGS

In the following, the invention will be described in greater detail with reference to the drawing, which is not to be considered as restricting of the present invention, and which shows.

DETAILED DESCRIPTION OF THE INVENTION

Figure 1:
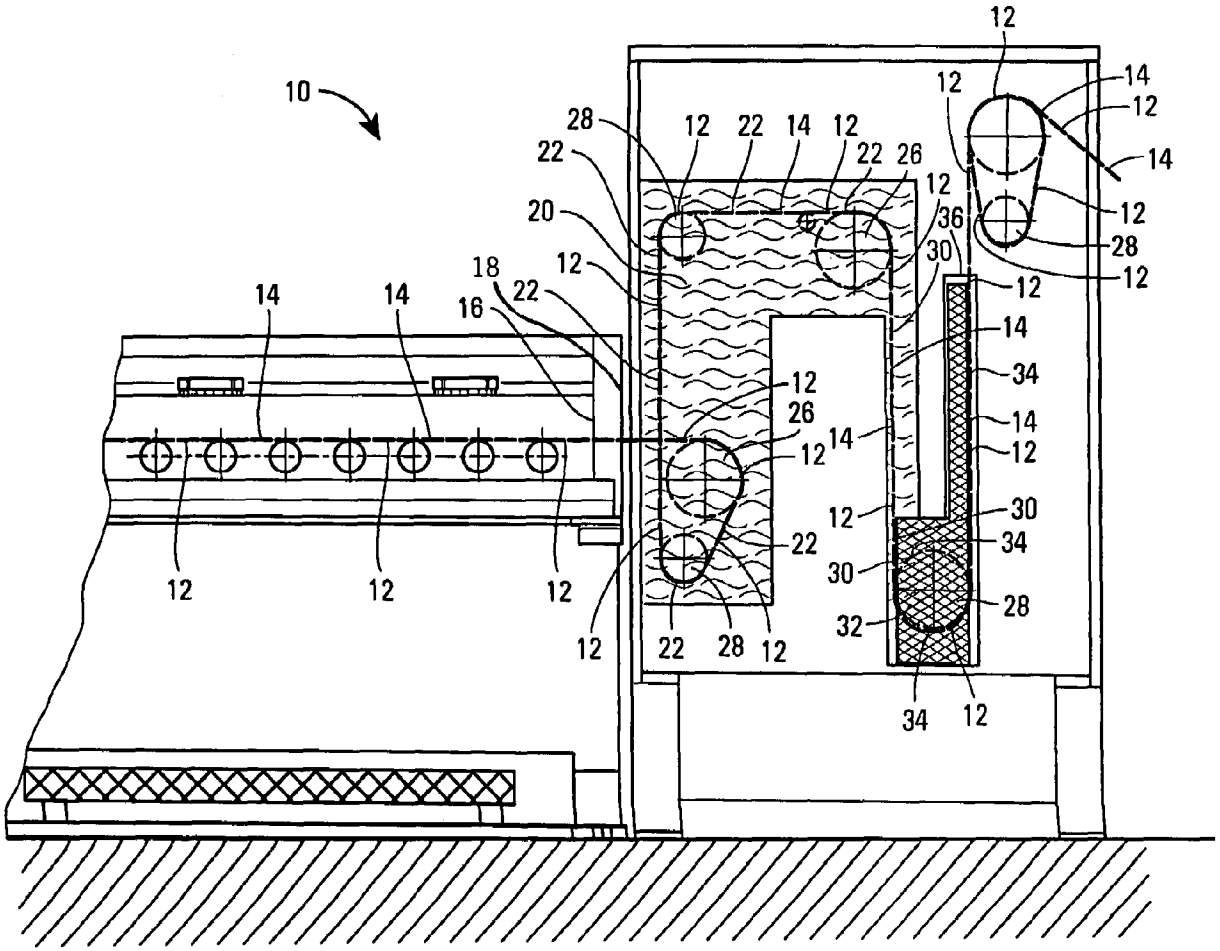
FIG. 1 shows a schematic partial cut-away view of an exemplary embodiment in accordance with the present invention.

The annealing apparatus 10 depicted in FIG. 1 is disposed with a transport track 12 along which an aluminum-comprising billet 14 can be moved. The aluminum-comprising billet 14 is drawn through a die 18 arranged at the end of cold-processing means 16. The aluminum-comprising billet 14 is then moved through an area provided with protective gas 20. A part of this area in which the aluminum comprising billet 14 is moved through the protective gas 20 is an annealing path 22.

The annealing path 22 is bordered by a first contact plate 24 and a second contact plate 26. The first contact plate 24, which is in particular a negative pole, is preferably a draw plate able to exert a force on the aluminum-comprising billet 14 so as to move it.

The first contact plate 24 as well as the second contact plate 26 are both connected to a voltage source and comprise aluminum so that the billet positioned respectively at the annealing path 22 is heated. The billet is guided by various deflection rollers 28.

Subsequent to annealing path 22, the aluminum-comprising billet 14 is moved along a second annealing path 30 which is bordered by the second contact plate 26 and a third contact plate 32.

Contact plates 32, 24 have the identical potential, which differs from the potential of contact plate 26.

The aluminum-comprising billet 14—already partly through annealing path 30 in the present given depiction—is cooled by a thin oil 34 prior to the oil being removed from the aluminum-comprising billet 14 by a stripping means, depicted here as die 36.

Annealing apparatus 10 is further disposed with a second draw plate which applies such a force on said aluminum-comprising billet 14 so as to move it.

We claim:

1. Annealing apparatus for annealing metallic billets, comprising at least two contact elements made of electrically conducting material which are electrically connected to a voltage source and which receive a billet of a light metal or a light metal alloy in the form of at least one metallic wire, in such a manner that said billet moves relative to said contact element and an electric current flows through said billet between said elements, the material of at least one contact element is a metal alloy which is adapted to the material of said billet such that substantially no material from said billet diffuses into said contact element, at least one cold-processing means comprising at least one drawing die through which said billet is drawn by a draw plate, wherein said draw plate is the first contact element in the material flow direction behind the cold processing means, and a transport track for moving said billet through the apparatus, wherein a section of said transport track is provided with protective gas.

2. Apparatus according to claim 1, wherein said billet material is one of aluminum and an aluminum alloy and said contact element material is one of aluminum and an aluminum alloy.

3. Apparatus according to claim 1, wherein said billet material is a light metal, and said contact element material is made from the same light metal or from an alloy of the same light metal.

4. Apparatus according to claim 1, wherein said billet can be moved through said annealing apparatus along a predefined transport track.

5. Apparatus according to claim 1, wherein said contact elements between which said billet is contacted for electrical current flow through said billet are produced of substantially the same material.

6. Apparatus according to claim 1, further comprising a plurality of annealing paths, wherein one annealing path includes at least two contact elements for receiving a billet such that during the movement of said billet, an electrical current can flow through said billet between said contact elements and wherein one contact element is encompassed in one or more annealing paths.

7. Apparatus according to claim 1, further comprising at least one guiding means which does not function as contact element under certain circumstances, so that the billet is transported along predetermined sections of a transport track through said annealing apparatus without said billet being subjected to an electrical current flow in said sections.

8. Apparatus according to claim 7, wherein said guiding means comprise one of deflection rollers and comb rollers.

9. Apparatus according to claim 1, wherein at least one predetermined section of a transport track for moving said billet through said apparatus is a cooling section in which said billet can be cooled.

10. Apparatus according to claim 9, wherein said billet is moved through a cooling medium within said cooling section.

11. Apparatus according to claim 10, wherein said cooling medium is an oil.

12. Apparatus according to claim 9, further comprising a stripping means disposed after said cooling section and adapted to remove coolant from the surface of said billet, the stripping means including a drawing die, wherein said stripping means is arranged such that it can be cooled or lubricated by said coolant.

13. Apparatus according to claim 1, wherein said billet is moved through a protective gas in at least one predetermined section of a transport track for moving the billet through the apparatus.

14. Apparatus according to claim 1, further comprising a cold-processing means and a cooling section, wherein the section of said transport track provided with protective gas is arranged between said cold-processing means and said cooling section and wherein an annealing path is arranged on said transport track between said cold-processing means and said cooling section.

15. Apparatus according to claim 1, further comprising at least one drawing means for applying a force to said billet to cause said billet to move along a transport track through the apparatus.

16. Apparatus according to claim 15, wherein said drawing means is a draw disc.

17. Apparatus according to claim 1, wherein said at least two contact elements are provided with separate drive means.

18. Apparatus according to claim 17, further comprising a control and regulating means which controls said drive means of said contact elements so as to prevent any slippage of the billet due to the changing length of said billet.

19. Annealing apparatus for aluminum-containing billets, comprising at least two contact elements made of electrically conducting material which are electrically connected to a voltage source and which receive a billet in such a manner that said billet moves relative to said contact element and an electric current flows through said billet between said contact elements, the material of at least one contact element is one of aluminum and an aluminum alloy into which substantially no material from said billet diffuses, and further comprises at least one cold-processing means comprising at least one drawing die through which said billet is drawn by a draw plate, wherein said draw plate is the first contact element in the material flow direction behind the cold-processing means, and a transport track for moving said billet through the apparatus, wherein a section of said transport track is provided with protective gas.

20. Apparatus according to claim 19, wherein said billet can be moved through said annealing apparatus along a predefined transport track.

21. Apparatus according to claim 19, further comprising a plurality of annealing paths, wherein one annealing path includes at least two contact elements for receiving a billet such that during the movement of said billet, an electrical current can flow through said billet between said contact elements and wherein one contact element is encompassed in one or more annealing paths.

22. Apparatus according to claim 19, wherein at least one predetermined section of a transport track for moving said billet bracket through said apparatus is a cooling section in which said billet can be cooled.

23. Method of manufacturing a metallic, low-stress billet comprising the steps of:

transporting a billet, in the form of at least one metallic wire, along a transport track, such that said billet comes into contact with at least two contact elements, which are connected to a voltage source, in at least one predetermined section of said transport track;

cold-forming of said at least one metallic wire by means of a cold-processing device having at least one drawing die and a draw plate applying a drawing force, said draw plate being used as the first contact element in the material flow direction behind the cold-processing means;

allowing an electrical current to flow through a segment of said billet between said contact elements during the transport of said billet; and selecting the material of said contact elements to contain one of aluminum and an aluminum alloy to match to the material of said billet, such that substantially no embrittlement or diffusion arises between the contact element material and the billet material during transport of said billet, or during the flowing of the current through said billet;

wherein the flow of said electrical current through said billet causes said billet to be annealed at low stress, and wherein the annealing is performed in a protective gas atmosphere.

24. Method according to claim 23, further comprising the step of cooling said billet following annealing by means of an oil.

25. Method according to claim 24, further comprising the step of stripping off said oil from said billet employing a drawing die.

26. Apparatus according to claim 11, wherein said oil is a thin oil.

27. Method according to claim 23, wherein the contact elements are selected to contain an aluminum alloy.

28. Method according to claim 24, wherein the oil is a thin oil.

* * * * *